US011230962B2

(12) United States Patent
Jeong

(10) Patent No.: US 11,230,962 B2
(45) Date of Patent: Jan. 25, 2022

(54) RESERVOIR TANK WITH INTEGRATED EJECTOR

(71) Applicants: Hyundai Motor Company, Seoul (KR); Kia Motors Corporation, Seoul (KR)

(72) Inventor: Seong Bin Jeong, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 83 days.

(21) Appl. No.: 16/663,200

(22) Filed: Oct. 24, 2019

(65) Prior Publication Data

US 2020/0386145 A1 Dec. 10, 2020

(30) Foreign Application Priority Data

Jun. 5, 2019 (KR) ..... 10-2019-0066921

(51) Int. Cl.
*F01P 9/04* (2006.01)
*F01P 11/02* (2006.01)

(52) U.S. Cl.
CPC ..... *F01P 9/04* (2013.01); *F01P 11/029* (2013.01)

(58) Field of Classification Search
CPC ..... F01P 9/04; F01P 11/029; F01P 11/0285
See application file for complete search history.

(56) References Cited

U.S. PATENT DOCUMENTS

| | | | | |
|---|---|---|---|---|
| 4,480,598 | A * | 11/1984 | Berrigan | F01P 11/029 123/41.27 |
| 10,794,265 | B2 * | 10/2020 | Dumas | F01P 11/028 |
| 2008/0190385 | A1 * | 8/2008 | Bangert | F01P 11/028 123/41.54 |
| 2009/0095761 | A1 * | 4/2009 | Wada | F01P 11/028 220/660 |
| 2013/0048643 | A1 * | 2/2013 | Flajnik | F01P 11/029 220/562 |
| 2017/0350307 | A1 * | 12/2017 | Kerkewitz | F01P 11/029 |
| 2018/0283261 | A1 * | 10/2018 | Morishita | F01P 11/029 |
| 2020/0149463 | A1 * | 5/2020 | Trythall | B01D 36/001 |

* cited by examiner

*Primary Examiner* — Joseph J Dallo
*Assistant Examiner* — Kurt Philip Liethen
(74) *Attorney, Agent, or Firm* — Morgan, Lewis & Bockius LLP

(57) ABSTRACT

A reservoir tank with an integrated ejector, includes: a tank body having a space in which a coolant and a gas are contained; and an ejector integrally coupled to the tank body, wherein the ejector is configured to cool the gas produced from a gas source using the coolant contained in the tank body before the gas flows into the tank body.

11 Claims, 6 Drawing Sheets

RESERVOIR TANK WITH INTEGRATED EJECTOR

CROSS-REFERENCE TO RELATED APPLICATION

This application is based on and claims the benefit of priority to Korean Patent Application No. 10-2019-0066921, filed on Jun. 5, 2019, in the Korean Intellectual Property Office, the disclosure of which is incorporated herein in its entirety by reference.

TECHNICAL FIELD

The present disclosure relates to a reservoir tank with an integrated ejector, and more particularly, to a reservoir tank with an integrated ejector, capable of cooling a gas drawn into the reservoir tank from a gas source (a radiator, an engine-side water jacket, a turbo-side water jacket, etc.) in a cooling system for a vehicle using a coolant.

BACKGROUND

In general, when a vehicle is in operation, an explosion temperature in an engine combustion chamber reaches a high temperature of about 1500° C. If it is not properly cooled, there are problems such as engine overheating causing damage to various components as well as the engine, reduced viscosity of lubricating oil, and abnormal combustion, making the engine inoperable. Thus, the vehicle is equipped with a cooling system for cooling the engine.

The cooling system includes a water jacket formed in a cylinder block and a cylinder head of the engine, a radiator fluidly connected to the water jacket, a heater core heating air supplied to the interior of the vehicle using a coolant heated in the water jacket, and a reservoir tank fluidly connected to the water jacket and the radiator.

In addition, a turbocharger may be disposed adjacent to one side of the engine. The turbocharger is a device for increasing power output by turning a turbine using the engine's exhaust gas pressure inevitably generated by the internal combustion engine, and then pushing the intake air with a pressure higher than atmospheric pressure using this turning force.

The turbocharger may cause abnormal wear and seizure of bearings due to the heat of the exhaust gas and the high number of turns of the turbine. Thus, a water jacket may be formed inside the turbocharger, and the water jacket of the turbocharger (hereinafter, "turbo-side water jacket") may be fluidly connected to the water jacket of the engine (hereinafter, "engine-side water jacket") through a coolant line of the engine.

The reservoir tank is divided into a non-pressurized reservoir tank and a pressurized reservoir tank. Recently, the pressurized reservoir tank has been mainly used in accordance with high performance of the engine.

The pressurized reservoir tank may keep its internal pressure constant by a pressure cap mounted on top thereof. In addition, the pressurized reservoir tank may be directly connected to the engine-side water jacket and/or the turbo-side water jacket through a degassing line so that gases produced in the engine-side water jacket and/or the turbo-side water jacket may be drawn into the reservoir tank through the degassing line. Thus, degassing may be effectively performed.

High-temperature gases (or hot gases) may be produced in the engine-side water jacket, the turbo-side water jacket, the radiator, etc. according to coolant circulation mode and the like, and such high-temperature gases may be drawn into the reservoir tank through the degassing line. In particular, the engine system is more likely to produce the high-temperature gases in the turbo-side water jacket than in the engine-side water jacket. Degassing of the high-temperature gases, which allows the high-temperature gases to be drawn into the reservoir tank, may be carried out mainly in the turbo-side water jacket.

In general, when a starting system of a vehicle is in a key on state, a water pump in a cooling system circulates a coolant to allow the cooling of the coolant in the radiator and thus the low-temperature coolant passing through the engine-side water jacket may flow into the turbo-side water jacket, allowing the turbocharger to be properly cooled.

However, when the starting system of the vehicle is in a key off state, the water pump in the cooling system does not operate and the coolant does not circulate. Since the coolant is not cooled by the radiator, the coolant remaining in the turbo-side water jacket may be vaporized by the high temperature of the turbocharger, resulting in the production of high-temperature gases. The high-temperature gases produced in the turbo-side water jacket may be drawn into the inside of the reservoir tank through the degassing line due to pressure difference. As the high-temperature gases are drawn into the inside of the reservoir tank, the temperature of the coolant may exceed a maximum coolant temperature to be managed while the vehicle is driving. For example, the maximum coolant temperature to be managed during the driving of the vehicle may be 110° C., but the temperature of the coolant in the key off state of the starting system may increase to nearly 140° C., which is much higher than the maximum coolant temperature of 110° C., due to the high-temperature gases drawn into the reservoir tank.

As such, the high-temperature gases drawn into the reservoir tank in the key off state of the starting system may cause the pressurized reservoir tank to deteriorate. For example, when the pressurized reservoir tank is designed to have a maximum heat resistance temperature of 120° C., the temperature of the coolant rises to nearly 140° C. due to the high-temperature gases, which may cause the deterioration of the pressurized reservoir tank.

In addition, as the high-temperature gases are drawn into the inside of the reservoir tank in the key off state of the starting system, bubbling noise may be generated in the pressurized reservoir tank.

The above information described in this background section is provided to assist in understanding the background of the inventive concept, and may include any technical concept which is not considered as the prior art that is already known to those skilled in the art.

SUMMARY

The present disclosure has been made to solve the above-mentioned problems occurring in the prior art while advantages achieved by the prior art are maintained intact.

An aspect of the present disclosure provides a reservoir tank with an integrated ejector, capable of cooling a gas drawn into the reservoir tank from a gas source (a radiator, an engine-side water jacket, a turbo-side water jacket, etc.) in a cooling system for a vehicle using a coolant.

According to an aspect of the present disclosure, a reservoir tank with an integrated ejector may include: a tank body having a space in which a coolant and gas are contained; and an ejector integrally coupled to the tank body, wherein the ejector may be configured to cool gas produced from a gas source using the coolant contained in the tank body before gas flows into the tank body.

The ejector may include a first passage, a second passage straightly connected to the first passage, a nozzle located between the first passage and the second passage, and a third passage connected to the second passage. The first passage may be configured to fluidly to be connected to the gas source, and the third passage may be configured to fluidly connecting the tank body to the second passage.

The ejector may include an ejector body and an intake tube extending from the ejector body, the first passage, the second passage, and the nozzle may extend within the ejector body in an axial direction of the ejector body, and the third passage may extend within the intake tube in an axial direction of the intake tube.

The tank body may include an upper tank body and a lower tank body, the upper tank body may have an upper space, and the lower tank body may have a lower space.

The intake tube may have an inlet at a bottom end thereof, and the inlet of the intake tube may be located in the lower space of the lower tank body.

The ejector may further include a guide tube extending from the ejector body toward the lower tank body, and the guide tube may have a guide passage directly communicating with the second passage.

The guide tube may have an outlet at a bottom end thereof, and the outlet of the guide tube may be located in the lower space of the lower tank body.

The lower tank body may include a cylindrical inner wall surrounding the outlet of the guide tube.

The lower tank body may have a return-side nipple discharging the coolant, and the return-side nipple may have an inlet located in the lower space and an outlet located outside the lower tank body.

The upper tank body may have an upper partition surrounding the intake tube, and the upper partition may have at least one upper opening.

The lower tank body may have a lower partition surrounding an outlet of the intake tube and the inlet of the return-side nipple, and the lower partition may have at least one lower opening.

The ejector body may further include an insert tube inserted into an inner surface thereof, and the insert tube may comprise a heat resistant material.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
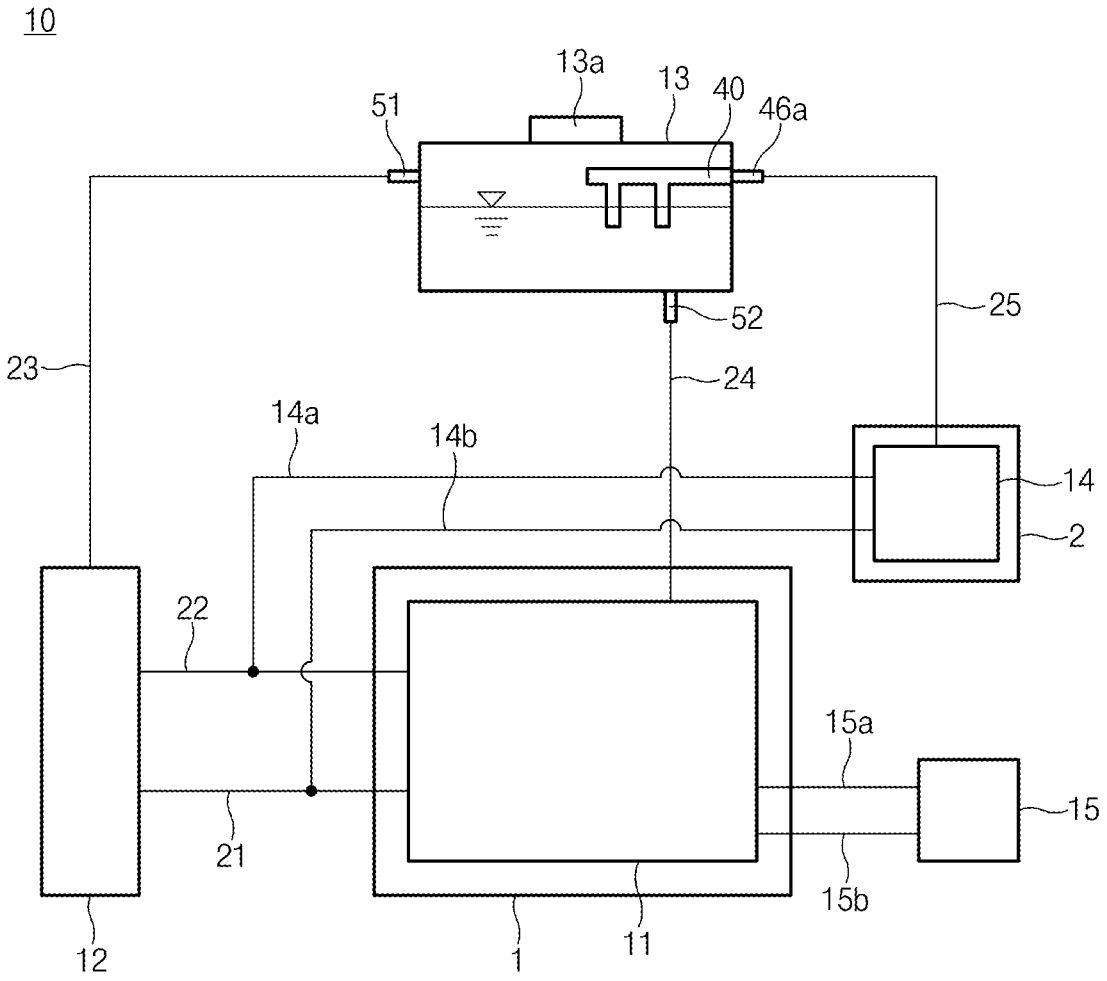
FIG. 1 illustrates the configuration of a cooling system for a vehicle to which a reservoir tank with an integrated ejector according to an exemplary embodiment of the present disclosure is applied.

Hereinafter, exemplary embodiments of the present disclosure will be described in detail with reference to the accompanying drawings. In the drawings, the same reference numerals will be used throughout to designate the same or equivalent elements. In addition, a detailed description of well-known techniques associated with the present disclosure will be ruled out in order not to unnecessarily obscure the gist of the present disclosure.

Terms such as first, second, A, B, (a), and (b) may be used to describe the elements in exemplary embodiments of the present disclosure. These terms are only used to distinguish one element from another element, and the intrinsic features, sequence or order, and the like of the corresponding elements are not limited by the terms. Unless otherwise defined, all terms used herein, including technical or scientific terms, have the same meanings as those generally understood by those with ordinary knowledge in the field of art to which the present disclosure belongs. Such terms as those defined in a generally used dictionary are to be interpreted as having meanings equal to the contextual meanings in the relevant field of art, and are not to be interpreted as having ideal or excessively formal meanings unless clearly defined as having such in the present application.

Referring to FIG. 1, a cooling system 10 for a vehicle may include an engine-side water jacket 11 formed in an engine 1, a radiator 12 fluidly connected to the engine-side water jacket 11, a pressurized reservoir tank 13 fluidly connected to the radiator 12 and the engine-side water jacket 11, a turbo-side water jacket 14 formed in a turbocharger 2 adjacent to the engine 1, and a heater core 15 fluidly connected to the engine-side water jacket 11.

The engine-side water jacket 11 may be formed in a cylinder block and a cylinder head of the engine 1. As a coolant supplied from the radiator 12 circulates the engine-side water jacket 11, the engine 1 may be properly cooled.

The radiator 12 may fluidly communicate with the engine-side water jacket 11 through a lower radiator hose 21 and an upper radiator hose 22. As the radiator 12 is disposed adjacent to a front grille of the vehicle, the radiator 12 may be cooled by ambient air and the like. A cooling fan (not shown) may be disposed adjacent to the rear of the radiator 12. The low-temperature coolant cooled by the radiator 12 may be transferred to the engine-side water jacket 11 through the lower radiator hose 21. As the coolant circulates the engine-side water jacket 11, it may be heated, and the heated coolant may flow back from the engine-side water jacket 11 to the radiator 12 through the upper radiator hose 22.

The pressurized reservoir tank 13 may fluidly communicate with the radiator 12 through a radiator-side degassing line 23. As the coolant is vaporized in the radiator 12, gas may be produced in the radiator 12. The gas may be drawn into the pressurized reservoir tank 13 through the radiator-side degassing line 23. One end of the radiator-side degassing line 23 may be directly connected to an upper end of the pressurized reservoir tank 13, and the other end of the radiator-side degassing line 23 may be connected to the radiator 12. In particular, a portion of the pressurized reservoir tank 13 to which one end of the radiator-side degassing line 23 is connected may be positioned higher than a predetermined maximum level of the coolant contained in the pressurized reservoir tank 13.

Figure 2:
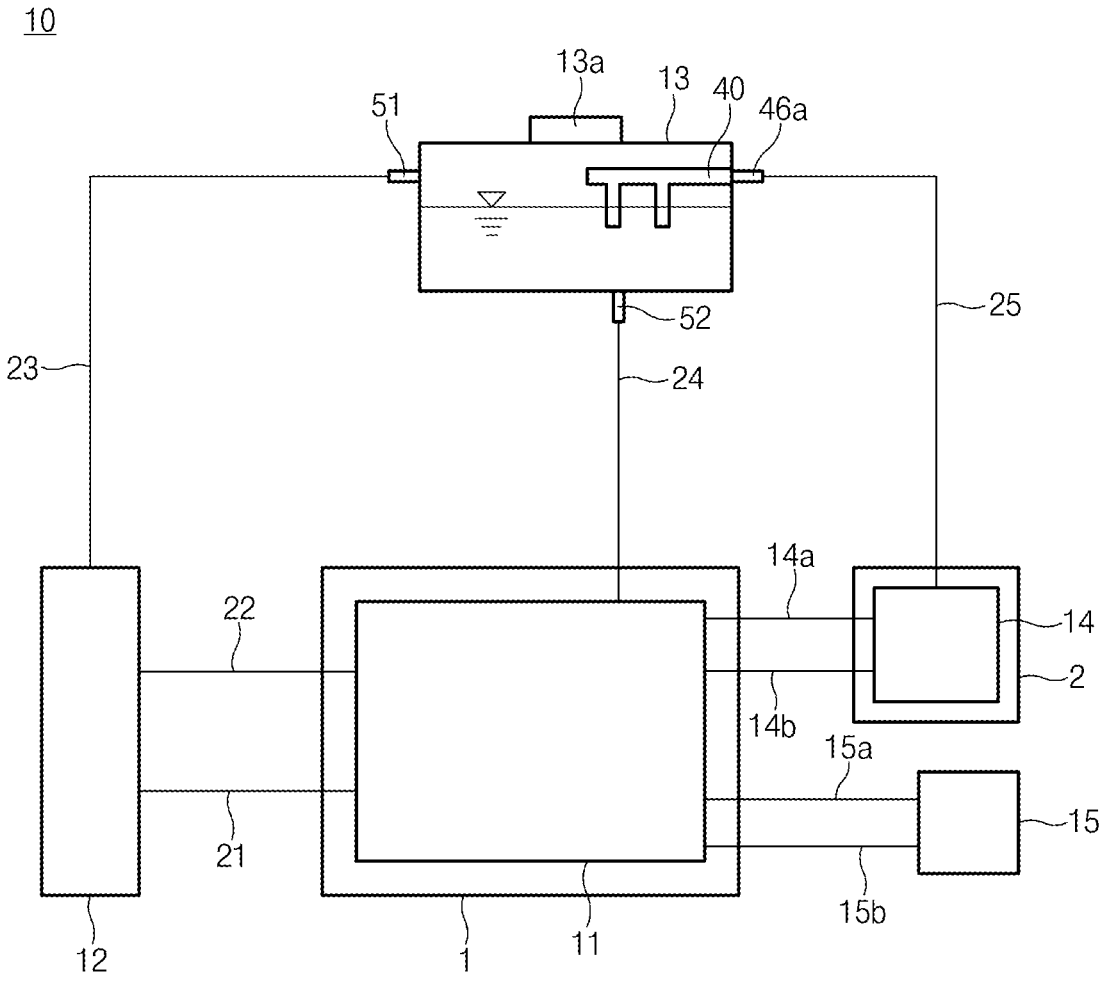
FIG. 2 illustrates another configuration of a cooling system for a vehicle to which a reservoir tank with an integrated ejector according to an exemplary embodiment of the present disclosure is applied.

The pressurized reservoir tank 13 may fluidly communicate with the cooling system 10 through a return hose 24, so that the coolant contained in the pressurized reservoir tank 13 may flow back to the cooling system 10. For example, the pressurized reservoir tank 13 may be fluidly connected to the engine-side water jacket 11 and/or the radiator 12, and the coolant stored in the pressurized reservoir tank 13 may flow back to the engine-side water jacket 11 and/or the radiator 12 through the return hose 24. FIGS. 1 and 2 illustrate the connection of the pressurized reservoir tank 13 to the engine-side water jacket 11 through the return hose 24.

The pressurized reservoir tank 13 may have a pressure cap 13*a* on top thereof, and the pressure cap 13*a* may be designed to keep the internal pressure of the pressurized reservoir tank 13 constant.

The turbo-side water jacket 14 may be formed in the turbocharger 2 adjacent to the engine 1. The turbo-side water jacket 14 may fluidly communicate with the engine-side water jacket 11 or the radiator 12 through a pair of turbo-side connection passages 14*a* and 14*b*.

Referring to FIG. 1, the turbo-side water jacket 14 may fluidly communicate with the radiator 12 through the pair of turbo-side connection passages 14*a* and 14*b*, and the turbo-side water jacket 14 and the engine-side water jacket 11 may be connected in parallel to the radiator 12.

Referring to FIG. 2, the turbo-side water jacket 14 may fluidly communicate with the engine-side water jacket 11 through the pair of turbo-side connection passages 14*a* and 14*b*, and the turbo-side water jacket 14 and the engine-side water jacket 11 may be connected in series to the radiator 12.

The turbo-side water jacket 14 may fluidly communicate with the pressurized reservoir tank 13 through a turbo-side degassing line 25. As the coolant is vaporized in the turbo-side water jacket 14, a high-temperature gas (or hot gas) may be produced. The high-temperature gas may be drawn into the pressurized reservoir tank 13 through the turbo-side degassing line 25.

The heater core 15 may fluidly communicate with the engine-side water jacket 11 through a pair of connection passages 15*a* and 15*b*. As the coolant flows into the engine-side water jacket 11, it may be heated, and at least a portion of the heated coolant may flow into the heater core 15.

The pressurized reservoir tank 13 with an integrated ejector, according to exemplary embodiments of the present disclosure, may be configured to cool the high-temperature gas produced by the vaporization of the coolant using the coolant contained in the pressurized reservoir tank 13 before the high-temperature gas is received in the pressurized reservoir tank 13.

According to an exemplary embodiment, the pressurized reservoir tank 13 with the integrated ejector may include a tank body 30 having spaces 33 and 34 in which the coolant and the gas are contained, and an ejector 40 integrally coupled to the tank body 30.

Referring to FIGS. 3 to 6, the tank body 30 may include an upper tank body 31 and a lower tank body 32, and the upper tank body 31 and the lower tank body 32 may be detachably coupled to each other.

Figure 3:
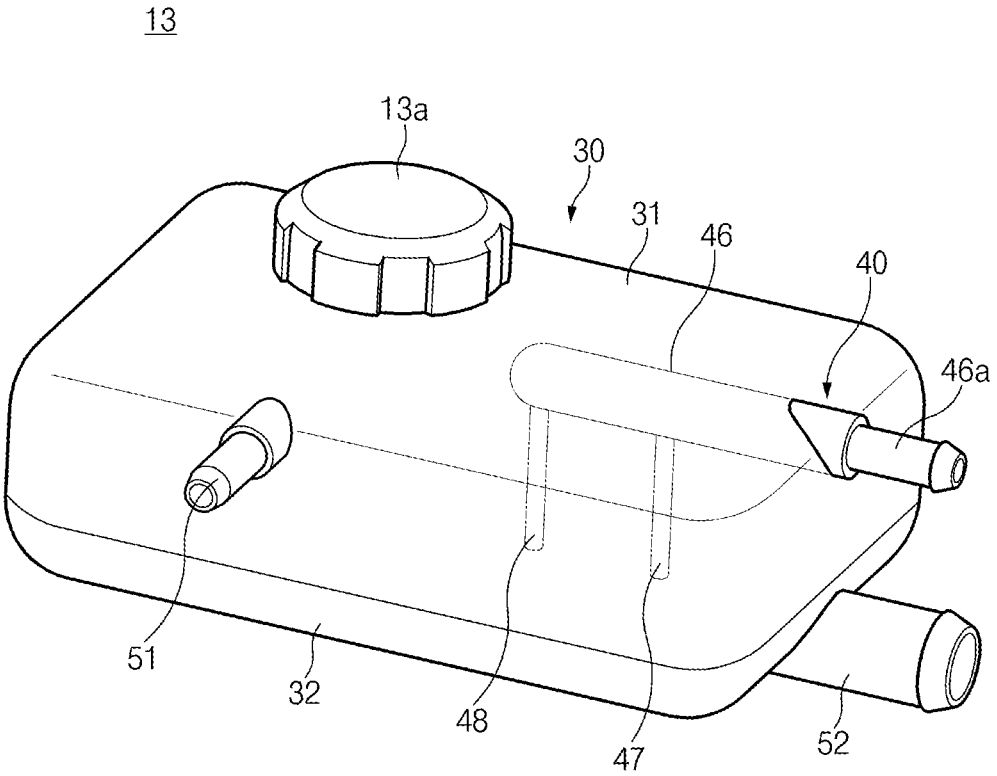
FIG. 3 illustrates a perspective view of a reservoir tank with an integrated ejector according to an exemplary embodiment of the present disclosure.
Figure 4:
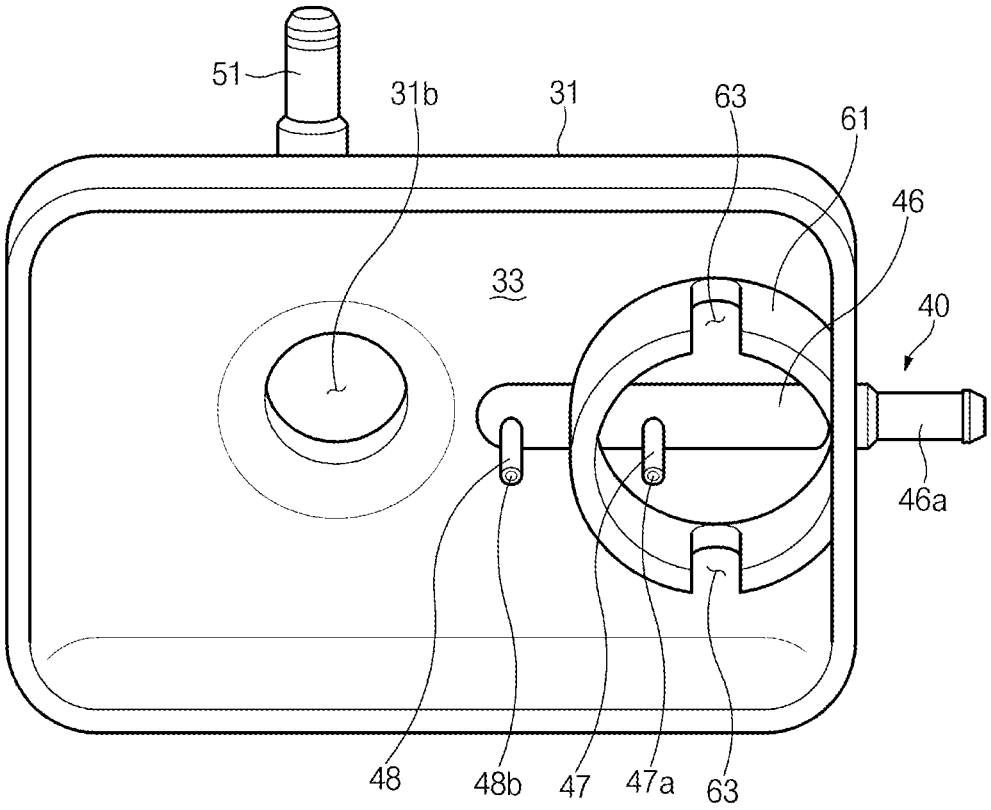
FIG. 4 illustrates a bottom perspective view of an upper tank body in a reservoir tank with an integrated ejector according to an exemplary embodiment of the present disclosure.

Referring to FIGS. 3 and 4, the upper tank body 31 may have an opening 31*b* on top thereof in which the pressure cap 13*a* is mounted. The upper tank body 31 may have a degassing-side nipple 51, and the radiator-side degassing line 23 may be sealingly connected to the degassing-side nipple 51. The upper tank body 31 may have an upper space 33 in which the coolant and the gas are contained, and the opening 31*b* and the degassing-side nipple 51 may communicate with the upper space 33.

Figure 5:
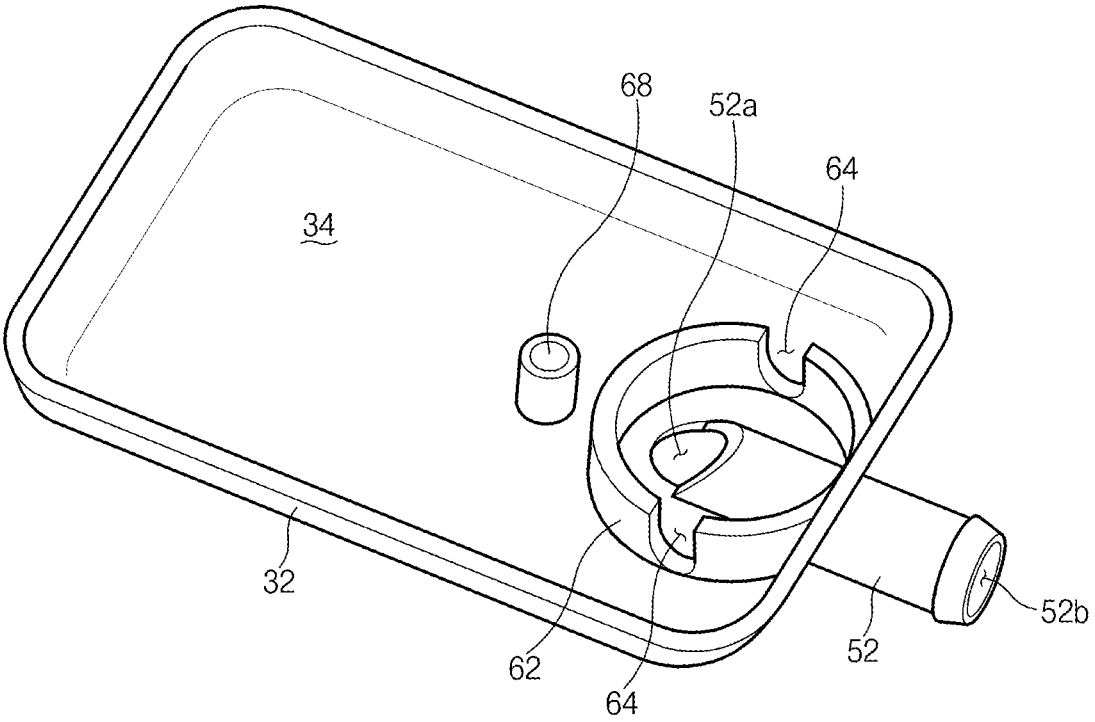
FIG. 5 illustrates a top perspective view of a lower tank body in a reservoir tank with an integrated ejector according to an exemplary embodiment of the present disclosure.

Referring to FIGS. 3 and 5, the lower tank body 32 may have a lower space 34 in which the coolant is contained. The lower tank body 32 may have a return-side nipple 52 discharging the coolant to the cooling system 10 for a vehicle, and the return hose 24 may be sealingly connected to the return-side nipple 52. The return-side nipple 52 may have an inlet 52*a* located in the lower space 34 of the lower tank body 32 and an outlet 52*b* located outside the lower tank body 32. As the coolant flows from the return-side nipple 52 to the engine-side water jacket 11 and the radiator 12, the coolant may be replenished to the engine-side water jacket 11 and/or the radiator 12.

The tank body 30 may be made of a transparent material, so that a level of the coolant may be easily observed with the naked eye. Referring to FIG. 3, the upper tank body 31 may be made of a transparent material.

Figure 6:
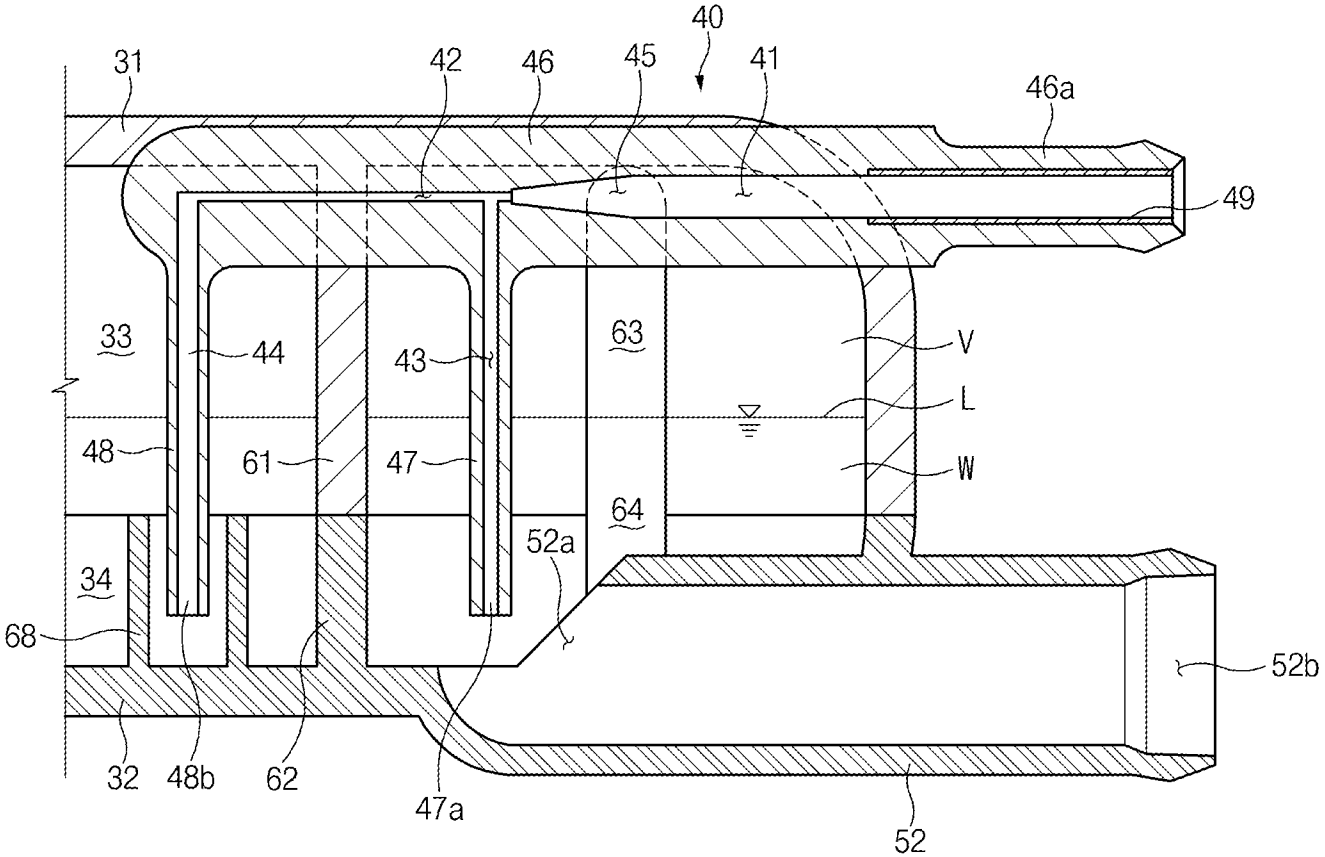
FIG. 6 illustrates a partial side sectional view of a reservoir tank with an integrated ejector according to an exemplary embodiment of the present disclosure.

Referring to FIG. 6, as the coolant and the gas flow into the spaces 33 and 34 of the tank body 30, a coolant layer W with a predetermined level L may be formed in the upper space 33 of the upper tank body 31 and the lower space 34 of the lower tank body 32, and a gas layer V may be formed on the level L of the coolant.

The ejector 40 may cool the high-temperature gas by mixing the high-temperature gas with the low-temperature coolant before the high-temperature gas is completely introduced into the spaces 33 and 34 of the tank body 30. In particular, the ejector 40 may spray the high-temperature gas at high speed to suck in the low-temperature coolant contained in the pressurized reservoir tank 13, and mix the high-temperature gas and the low-temperature coolant to allow the high-temperature gas to be cooled by the low-temperature coolant.

According to an exemplary embodiment, the coolant may be vaporized in the turbo-side water jacket 14 due to heat (high temperature) of the turbocharger 2 in a condition in which the coolant does not circulate in the cooling system 10, such as a key off state of a start switch. Since a large amount of high-temperature gas may be produced in the turbo-side water jacket 14, the ejector 40 may be configured to directly communicate with the turbo-side degassing line 25 as illustrated in FIGS. 1 and 2.

The ejector 40 may be integrally coupled or molded to an upper end of the upper tank body 31 by casting, so that the upper tank body 31 and the ejector 40 may form a unitary one-piece structure.

As illustrated in FIG. 6, the ejector 40 may include a first passage 41, a second passage 42 communicated with the first passage 41, a third passage 43 communicated with the second passage 42, and a nozzle 45 located between the first passage 41 and the second passage 42.

As the first passage 41 may be fluidly connected to a gas source, the gas produced from the gas source may flow into the second passage 42 through the first passage 41. As the third passage 43 may fluidly connect the tank body 30 to the second passage 42, the coolant contained in the tank body 30 may flow into the second passage 42 through the third passage 43. The first passage 41, the second passage 42, and the nozzle 45 may be connected in a line along a longitudinal direction of the ejector 40, and the third passage 43 may be connected to the second passage 42 to intersect with the first passage 41 and the second passage 42 at a predetermined angle. In particular, the third passage 43 may be connected to the second passage 42 to be perpendicular to the first passage 41 and the second passage 42. The second passage 42 may have a diameter smaller than that of the first passage 41, and the third passage 43 may have a diameter which is the same as or slightly smaller than that of the second passage 42.

The ejector 40 may include an ejector body 46 extending in the longitudinal direction, and an intake tube 47 extending from the ejector body 46.

The ejector body 46 may be integrally combined with an outer wall of the upper tank body 31, so that the ejector body 46 and the upper tank body 31 may form a unitary one-piece structure. The ejector body 46 may have a nipple 46*a* protruding from the outer wall of the upper tank body 31, and a degassing line such as the turbo-side degassing line 25 may be sealingly connected to the nipple 46*a*. The ejector body 46 may define the first passage 41, the second passage 42, and the nozzle 45, and the first passage 41, the second passage 42, and the nozzle 45 may extend within the ejector body 46 in an axial direction of the ejector body 46. In particular, the first passage 41, the second passage 42, and the nozzle 45 may be connected in a line along the axial direction of the ejector body 46.

The intake tube 47 may extend from the ejector body 46 toward the lower tank body 32. The intake tube 47 may have an inlet 47*a* located at a bottom end thereof, and the inlet 47*a* of the intake tube 47 may be located in the lower space 34 of the lower tank body 32. In particular, the inlet 47*a* of the intake tube 47 may be adjacent to the bottom of the lower tank body 32, and the inlet 47*a* of the intake tube 47 may directly communicate with the lower space 34 of the lower tank body 32. The intake tube 47 may define the third passage 43, and the third passage 43 may extend within the intake tube 47 in an axial direction of the intake tube 47. The third passage 43 may allow the inlet 47*a* to communicate with the second passage 42, and a top end of the third passage 43 may directly communicate with the second passage 42. The top end of the third passage 43 may be disposed adjacent to a downstream end of the nozzle 45. The third passage 43 may be disposed to be perpendicular to the first passage 41 and the second passage 42. The diameter of the third passage 43 may be the same as the diameter of the second passage 42 or be slightly smaller than the diameter of the second passage 42.

The first passage 41 may directly communicate with the gas source such as the radiator 12, the engine-side water jacket 11, and the turbo-side water jacket 14 through the degassing line.

According to an exemplary embodiment, the turbo-side degassing line 25 may allow the turbo-side water jacket 14 to communicate with the first passage 41 of the ejector 40. Thus, the high-temperature gas produced in the turbo-side water jacket 14 may flow into the first passage 41 of the ejector 40 through the turbo-side degassing line 25. The high-temperature gas may flow into the first passage 41 of the ejector 40 through the turbo-side degassing line 25 due to a pressure difference between the turbo-side water jacket 14 and the pressurized reservoir tank 13. The high-temperature gas flowing into the first passage 41 of the ejector 40 may increase speed and decrease pressure as it passes through the nozzle 45, causing a negative pressure in the second passage 42. The coolant contained in the space 34 of the lower tank body 32 may pass through the third passage 43 of the intake tube 47 to be drawn into the second passage 42 of the ejector 40. Thus, the high-temperature gas and the low-temperature coolant may be mixed in the second passage 42, so that the high-temperature gas may be cooled.

According to an exemplary embodiment, an insert tube 49 made of a heat resistant material such as metal may be inserted into an inner surface of the ejector body 46, and the insert tube 49 may have the same inner diameter as that of the first passage 41. In particular, the insert tube 49 may be inserted into an inner surface of the nipple 46*a*. When the high-temperature gas flows into the first passage 41 of the ejector body 46, the insert tube 49 may withstand the heat of the gas so that the heat resistance of the ejector body 46 may be improved.

The ejector 40 according to an exemplary embodiment of the present disclosure may further include a guide tube 48 extending from the ejector body 46 toward the lower tank body 32.

The guide tube 48 may have a guide passage 44 directly communicating with the second passage 42, and the guide passage 44 may be perpendicular to the second passage 42. The high-temperature gas and the low-temperature coolant may be mixed in the second passage 42, and the gas-containing coolant may be directly guided to the lower space 34 of the lower tank body 32 through the guide tube 48. The guide tube 48 may have an outlet 48*b* located at a bottom end thereof, and the guide passage 44 may allow the outlet 48*b* to communicate with the second passage 42. The outlet 48*b* of the guide tube 48 may be located in the lower space 34 of the lower tank body 32. In particular, the outlet 48*b* of the guide tube 48 may be adjacent to the bottom of the lower tank body 32, and the outlet 48*b* of the guide tube 48 may directly communicate with the lower space 34 of the lower tank body 32.

In the absence of the guide tube 48, the mixture of the gas and the coolant may be sprayed to the upper space 33 of the upper tank body 31 and/or the lower space 34 of the lower tank body 32 indiscriminately, noise may become severe. In this regard, the ejector 40 according to the exemplary embodiment of the present disclosure may allow the guide tube 48 to directly guide the high-temperature gas and the low-temperature coolant toward the coolant contained in the space of the lower tank body 32, thereby minimizing the generation of noise.

Referring to FIG. 6, the lower tank body 32 may include a cylindrical inner wall 68 surrounding the outlet 48*b* of the guide tube 48, and an inner surface of the inner wall 68 may be spaced apart from an outer surface of the guide tube 48 in a radial direction. As the gas-containing coolant discharged through the outlet of the guide tube 48 directly collides with the inner surface of the inner wall 68, bubbling caused by the gas may be prevented, and thus the generation of noise may be minimized.

Since the gas-containing coolant is introduced into the lower space 34 of the lower tank body 32 through the guide tube 48, the gas may be contained in the coolant layer W. It may take some time for the gas to be separated from the coolant layer W. When the gas-containing coolant flows into a water pump of the cooling system through the return-side nipple 52 of the pressurized reservoir tank 13 before the gas is separated from the coolant layer W, durability of the water pump may be reduced. As cavitation occurs in the water pump, the cooling performance of the engine may be reduced.

In order to minimize the inflow of the gas to the inlet 52*a* of the return-side nipple 52 of the lower tank body 32, partitions 61 and 62 may be disposed to surround the inlet 52*a* of the return-side nipple 52. Referring to FIGS. 4 and 6, the upper tank body 31 may have an upper partition 61 surrounding the intake tube 47 of the ejector 40, and the upper partition 61 may have at least one upper opening 63. Referring to FIGS. 5 and 6, the lower tank body 32 may have a lower partition 62 surrounding an outlet of the intake tube 47 and the inlet 52*a* of the return-side nipple 52, and the lower partition 62 may have at least one lower opening 64. As a bottom end of the upper partition 61 abuts a top end of the lower partition 62, the upper partition 61 and the lower partition 62 may be continuous within the tank body 30 in a vertical direction, and the upper partition 61 and the lower partition 62 may partially separate a space adjacent to the inlet 52*a* of the return-side nipple 52 from its peripheral space. As the upper partition 61 and the lower partition 62 surround the intake tube 47 of the ejector 40 and the inlet 52*a* of the return-side nipple 52, the gas may be primarily separated from the coolant layer W by the partitions 61 and 62, thereby minimizing the possibility of inflow of the gas into the inlet 52*a* of the return-side nipple 52. The coolant and the gas may flow into an interior space and an exterior space partitioned by the upper partition 61 and the lower partition 62 through the upper opening 63 and the lower opening 64.

In a condition in which the water pump of the cooling system does not operate, such as a starting system of a vehicle is in a key off state, the coolant remaining in the turbo-side water jacket 14 may be vaporized by the heat (high temperature) of the turbocharger 2, resulting in the production of the high-temperature gas. The high-temperature gas may be drawn into the first passage 41 of the ejector 40 through the turbo-side degassing line 25 due to the pressure difference between the turbo-side water jacket 14 and the pressurized reservoir tank 13. The high-temperature gas flowing into the first passage 41 of the ejector 40 may increase speed and decrease pressure as it passes through the nozzle 45, causing the negative pressure in the second passage 42. The low-temperature coolant contained in the tank body 30 may pass through the third passage 43 to be drawn into the second passage 42 of the ejector 40. Thus, the high-temperature gas and the low-temperature coolant may be mixed in the second passage 42, so that the high-temperature gas may be cooled. For example, in the key off state of the starting system, the temperature of the gas produced in the turbo-side water jacket 14 may be approximately 140° C., and the temperature of the coolant passing through the lower radiator hose 21 may be approximately 110° C. As the high-temperature gas is mixed with the coolant in the second passage 42 of the ejector 40, the temperature of the gas may be lowered.

According to the related art, when a high-temperature gas of approximately 140° C. is directly received in a pressurized reservoir tank, a material of a degassing hose may be a reinforced heat-resistant hose capable of withstanding a maximum temperature of 150° C. and a material of the pressurized reservoir tank may be nylon (e.g., PA66) by taking heat resistance into consideration. Thus, the material cost may be relatively increased. In addition, since PA66 has significantly low transparency, it may be difficult to identify the amount of the coolant contained in the pressurized reservoir tank with the naked eye.

On the other hand, according to exemplary embodiments of the present disclosure, since the high-temperature gas produced in the turbo-side water jacket 14 and the like is reduced by the low-temperature coolant in the second passage 42 of the ejector 40, the pressurized reservoir tank 13 may be made of an inexpensive general PP material. Thus, the material cost in the exemplary embodiments of the present disclosure may be significantly reduced compared to the related art. In addition, since the PP material has relatively high transparency, it may be easy to identify the amount of the coolant contained in the pressurized reservoir tank with the naked eye.

Luxury vehicles have adopted a cooling system using an additional electric water pump, in which the electric water pump is driven for a predetermined period of time after the key off of a start switch, thereby circulating the coolant in the cooling system. On the other hand, according to exemplary embodiments of the present disclosure, there is no need to mount the additional electric water pump since the temperature of the gas can be lowered by sucking in the low-temperature coolant using the gas's energy. In addition, the material cost may be significantly reduced considering the application of the pressurized reservoir tank in accordance with high performance of the engine.

According to exemplary embodiments of the present disclosure, the pressurized reservoir tank 13 is illustrated as having the turbo-side degassing line 25 connected to the ejector 40 to reduce the temperature of the high-temperature gas produced in the turbo-side water jacket 14, but is not limited thereto. To reduce the high-temperature gas produced in the radiator 12 or the high-temperature gas produced in the engine-side water jacket 11, the radiator-side degassing line or the engine-side degassing line may be connected to the ejector 40. In other words, the gas source is not limited to the turbo-side water jacket 14, and may include various parts, such as the radiator 12 and the engine-side water jacket 11, in which the high-temperature gas may be produced due to the vaporization of the coolant.

As set forth above, according to exemplary embodiments of the present disclosure, the high-temperature gas produced in the radiator, the engine-side water jacket, the turbo-side water jacket, etc. may be cooled in advance by the low-temperature coolant contained in the reservoir tank before the high-temperature gas flows into the reservoir tank through the degassing line. Thus, the deterioration of the reservoir tank, bubbling noise in the reservoir tank, and the like may be prevented.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A reservoir tank, the pressurized reservoir tank comprising:

a tank body having a space for accommodating a coolant and gas; and an ejector integrally coupled to the tank body, wherein the ejector is configured to be fluidly connected to a gas source, and configured to spray gas produced from the gas source into the space of the tank body, wherein the ejector includes a first passage, a second passage straightly connected to the first passage, a nozzle located between the first passage and the second passage, and a third passage connected to the second passage, wherein the first passage is configured to be fluidly connected to the gas source, wherein the third passage is configured to fluidly connecting the tank body to the second passage, wherein the ejector includes an ejector body and an intake tube extending from the ejector body, wherein the first passage, the second passage, and the nozzle extend within the ejector body in an axial direction of the ejector body, and wherein the third passage extends within the intake tube in an axial direction of the intake tube.

2. The reservoir tank according to claim 1, wherein the tank body includes an upper tank body and a lower tank body, wherein the upper tank body has an upper space, and the lower tank body has a lower space.

3. The reservoir tank according to claim 2, wherein the intake tube has an inlet at a bottom end thereof, and wherein the inlet of the intake tube is located in the lower space of the lower tank body.

4. The reservoir tank according to claim 3, wherein the ejector further includes a guide tube extending from the ejector body toward the lower tank body, and wherein the guide tube has a guide passage directly communicating with the second passage.

5. The reservoir tank according to claim 4, wherein the guide tube has an outlet at a bottom end thereof, and wherein the outlet of the guide tube is located in the lower space of the lower tank body.

6. The reservoir tank according to claim 5, wherein the lower tank body includes a cylindrical inner wall surrounding the outlet of the guide tube.

7. The reservoir tank according to claim 2, wherein the lower tank body has a return-side nipple discharging the coolant, and wherein the return-side nipple has an inlet located in the lower space and an outlet located outside the lower tank body.

8. The reservoir tank according to claim 7, wherein the upper tank body has an upper partition surrounding the intake tube, and wherein the upper partition has at least one upper opening.

9. The reservoir tank according to claim 7, wherein the lower tank body has a lower partition surrounding an outlet of the intake tube and the inlet of the return-side nipple, and wherein the lower partition has at least one lower opening.

10. The reservoir tank according to claim 1, wherein the ejector body further includes an insert tube inserted into an inner surface thereof, and wherein the insert tube comprises a heat resistant material.

11. A reservoir tank, the pressurized reservoir tank comprising:

a tank body having a space for accommodating a coolant and gas; and an ejector integrally coupled to the tank body, wherein the ejector is configured to cool gas produced from a gas source using the coolant contained in the tank body before gas flows into the tank body, wherein the ejector includes a first passage, a second passage straightly connected to the first passage, a nozzle located between the first passage and the second passage, and a third passage connected to the second passage, wherein the first passage is configured to be fluidly connected to the gas source, wherein the third passage is configured to fluidly connecting the tank body to the second passage, wherein the ejector includes an ejector body and an intake tube extending from the ejector body, wherein the first passage, the second passage, and the nozzle extend within the ejector body in an axial direction of the ejector body, and wherein the third passage extends within the intake tube in an axial direction of the intake tube.

* * * * *